US005857512A

United States Patent [19]

Engel

[11] Patent Number: 5,857,512

[45] Date of Patent: Jan. 12, 1999

[54] JEWELRY MODELS AND AN IMPROVED JEWELRY MODEL PRODUCED THEREFROM

[76] Inventor: Michael Engel, 31 W. 47th St., Room 701, New York, N.Y. 10036

[21] Appl. No.: 584,381

[22] Filed: Jan. 11, 1996

[51] Int. Cl.[6] ..... B22C 7/02; B22C 7/00

[52] U.S. Cl. ..... 164/15; 164/45; 164/235; 164/246; 264/36.1; 264/36.18; 264/226; 427/133; 427/135; 427/140; 427/142

[58] Field of Search ..... 164/15, 44, 45, 164/235, 244, 246; 427/135, 142, 133, 140; 264/226, 36.1, 36.18

[56] References Cited

U.S. PATENT DOCUMENTS 3,085,895 4/1963 Gutman ..... 164/45 X 4,876,118 10/1989 Wallbillich ..... 427/142

5,077,086 12/1991 Cavill ..... 427/142 X

FOREIGN PATENT DOCUMENTS 53-63216 6/1978 Japan ..... 164/45

*Primary Examiner*—J. Reed Batten, Jr.

*Attorney, Agent, or Firm*—Levisohn, Lerner, Berger & Langsam

[57] ABSTRACT

A nail polish or nail polish/enamel composition is applied to imperfections, errors, distortions or porosities in the model. The composition is thus used to correct the model's shape. The composition can be added at room temperature, and avoids the need to utilize high temperatures in the process of building the model. The nail polish or nail polish/enamel compositions may be utilized to add jewelry design elements to the model.

24 Claims, 4 Drawing Sheets

JEWELRY MODELS AND AN IMPROVED JEWELRY MODEL PRODUCED THEREFROM

FIELD OF THE INVENTION

The present invention relates to an improved method for correcting the models utilized in the design and manufacture of jewelry. The method permits elimination of distortions, imperfections and porosity in the model without the use of heat, and allows layering of design elements on the model. The method also allows changes to the shape or appearance of the model to achieve a more attractive effect in the final jewelry. The present invention also relates to the jewelry model as thereby improved.

BACKGROUND OF THE INVENTION

The present invention relates to improved materials for the elimination of the numerous imperfections which often occur in the making of jewelry models and to a method for improving those models' appearance and/or shape.

The manufacture of jewelry is a lengthy process involving numerous steps. When a designer conceives of an idea for a new jewelry item (for example, a new ring), he or she may create a wax or gold carving or structure which illustrates the new design. This wax or gold structure is known as a "jewel model".

This jewelry model becomes the basis for all further manufacture of the jewelry. In a preferred method, an appropriate material (preferably silicone) is poured or molded around this model and left to harden. Upon hardening, the silicone is cut and the model inside is removed, leaving a silicone mold of the desired jewelry item. A casting of the jewelry is subsequently manufactured by pouring metal into the silicone mold, e.g. by pouring liquid metal into the mold. Once the silicone mold has been completed it can be used to make as many castings as desired, and thus, a single mold can be used to make a large number of pieces of jewelry.

Due to the fact that the silicone mold is used to make all further pieces, it is important that the jewelry model be as perfect as possible before the silicone mold is created. Imperfections, distortions, and porosities in the model (e.g. problems in the model's surface or structure) have to be removed before creation of the silicone mold so that these imperfections do not appear in the final manufactured product. Thus, an important part of the design and manufacturing process is removing these undesirable characteristics from the model, i.e. eliminating the model's imperfections, distortions, porosities and errors.

Numerous methods have been used in the prior art to correct these imperfections, for example, when the model is a gold structure. One method previously attempted has been to add wax to the model. This has proven unacceptable, however, since the wax can "slide" on the model, leading to further imperfections or distortions in the design. Moreover, it is difficult to work with wax, since the wax deforms too easily during handling.

The preferred method presently used involves the use of heat and solder. Soldered, heat-treated or torched areas of the model harden upon cooling, resulting in durable corrections in the model which are not easily deformed. However, the use of heat and solder has numerous disadvantages of its own. One particular disadvantage is that soldering makes it difficult to have combinations of multiple elements joined together as part of the jewelry model (particularly if they are small), or to add elements to the model. For example, if it is desired to have multiple gold beads on the model, the use of heat or solder can melt the beads, causing them to become deformed, and perhaps even ruining the gold beads entirely. Any technique using high temperatures would, in fact, face this problem and other similar ones, due to the effects of the heat on metal elements, particularly small elements or ones of certain compositions.

Accordingly, there is currently a need in the art for an improved method of refining jewelry models which overcomes the shortcomings currently present in the prior art. There is also a need for a corrective material which can be used to adjust the shape or appearance of jewelry models, or to correct imperfections therein, without the use of high temperatures.

SUMMARY OF THE INVENTION

An object of this invention is, therefore, to provide an alternative and improved method of compensating for distortion, porosity and imperfections in the making of jewelry models for jewelry without the use of heat or solder.

Another object of this invention is to provide a useful technique for enhancing the model making process.

Another object of this invention is to provide an improved technique in which combinations of multiple elements may be joined together as part of the jewelry model.

Another object of the invention is to provide an improved method for adjusting the shape or appearance of jewelry models, without the use of high temperatures.

Other objects, advantages and features of this invention will become more apparent hereinafter.

The present invention accomplishes its objectives by use of a nail polish or nail polish/enamel composition which is applied to a model before creation of the silicone mold. This composition is used to fill in or coat over imperfections or to adjust or correct the model's shape. The composition has been found to be superior to the compositions which are currently practiced in the art and allows correction of the model without the use of high temperatures. Thus, as opposed to the prior art, adjustments in the shape or structure of the jewelry model can be effected at temperatures below the melting point of the metal utilized for the model.

DETAILED DESCRIPTION OF THE PREFERRED EMBODIMENTS

The present inventor has discovered it is possible to utilize a nail polish or nail polish/enamel composition as a coating or filler material to compensate and correct errors and distortions in jewelry models. This composition is easy to work with and can be coated (e.g. layered or painted) onto the model in the desired locations. The composition is applied to areas of concern in the model, and when it hardens it corrects imperfections, errors, or distortions that were undesirable. Moreover, since no heat is used in the present method, there is no problem of introducing heat-induced distortions into the model during the correction process.

As another aspect of this invention, it has been found that a process of layering or adding jewelry or design elements to portions of a setting is substantially achievable using the composition and method of the present invention. This is accomplished by forming a substrate of nail polish on the model, adding the jewelry elements thereto, and allowing the substrate to harden. If desired, further substrates of nail polish and jewelry elements can be added to build up a new, unique and attractive decorative surface.

Thus, in the present invention multiple gold or metal beads can be used as part of a jewelry model, whereas in the prior art, if gold or metal beads were sought to be added, and the beads were too small, the heat used to add them would cause distortion or melting of the beads. In contrast to the difficulties previously arising when heat or solder was used, small beads of one-quarter of a millimeter in diameter can easily be added using the present method.

As yet a further aspect of the present invention, a composition can be added to the model to improve the model's appearance and/or shape.

Figure 1:
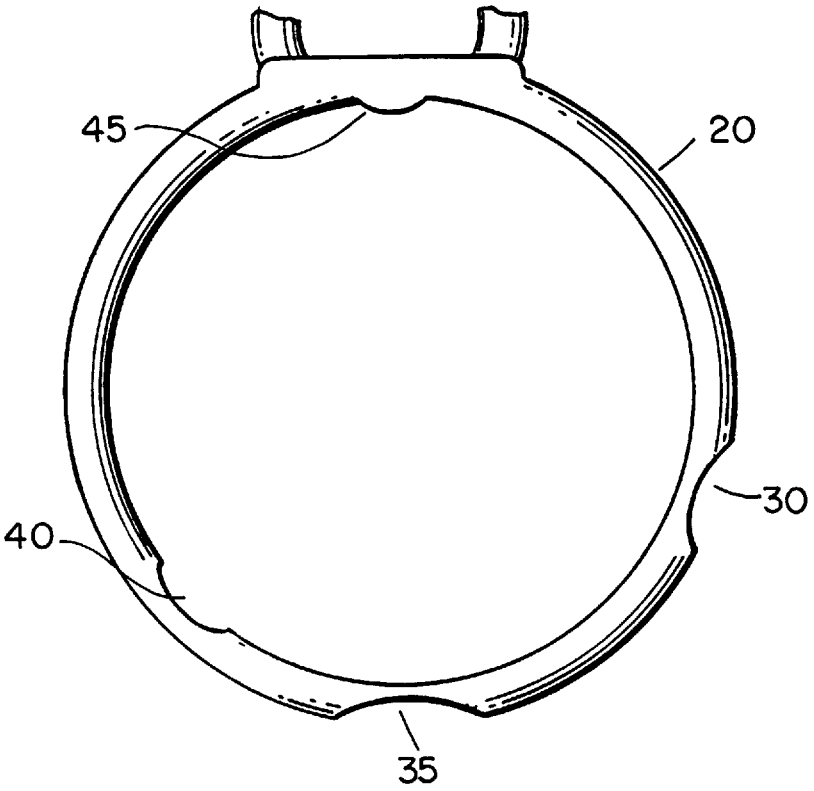
FIG. 1 shows a elevation view of a distorted jewelry model with numerous imperfections.

FIG. 1 shows an example of a distorted jewelry model 20. Although the figure uses a ring for illustration, it will be appreciated that the present method can be used with any kind of jewelry. Distorted jewelry model 20 has imperfections, distortions, errors, or porosity 30, 35, 40 and 45 formed therein. These imperfections must be corrected before a silicone mold is made.

To correct these imperfections, a nail polish composition is used. These compositions are well known in the arts of fashion and cosmetics, and refer to the many compositions used to color or coat women's nails. The compositions are inexpensive and readily available. Most importantly, they are superior to the materials currently used in the prior art of jewelry manufacturing for the correction of jewelry models. As an alternative to a composition containing nail polish alone, a nail polish/enamel combination is effective as well. The compositions do not require the addition of heat to be effective and can be used at room temperature if desired.

In contrast, the use of enamel alone as a filler material or corrective material is ineffective. Similarly, the use of glue alone is ineffective as well. The silicone poured around the jewelry model can flush away enamel or stick to glue, distorting the model. As noted above, the use of wax, solder or heat, also have their attendant disadvantages.

Figure 2:
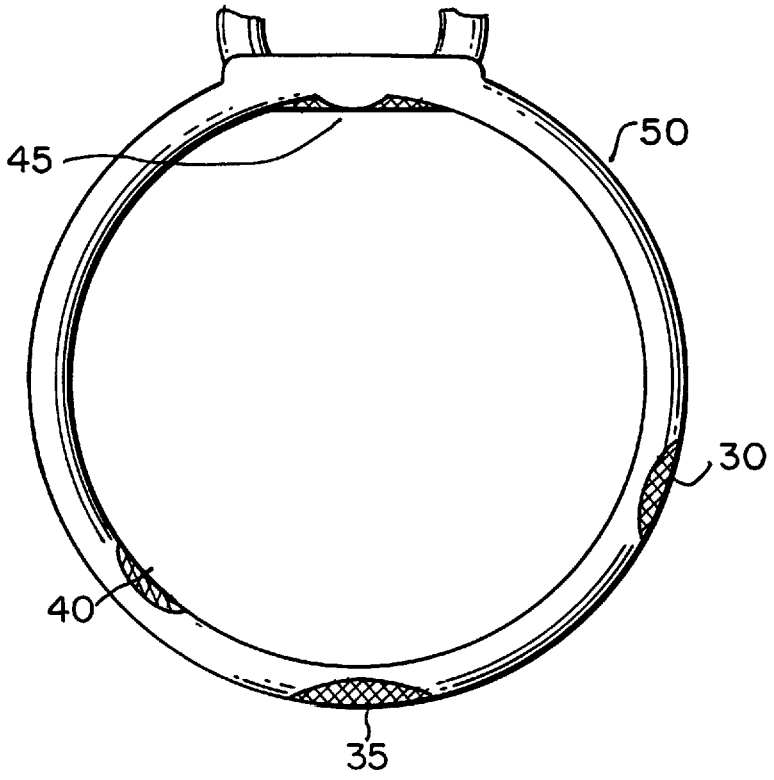
FIG. 2 shows a elevation view of the jewelry model of FIG. 1, with the imperfections corrected and additional design elements added.

FIG. 2 shows an improved or corrected jewelry model 50, after using the method and apparatus of the present invention. As shown in FIG. 2, the imperfections of FIG. 1 have been corrected by the addition of nail polish composition to the model. The areas to which nail polish has been added are indicated by shading. Thus, in FIG. 2, imperfections 30, 35, 40 and 45 are no longer apparent. The addition of nail polish or nail polish enamel to the model has corrected the imperfections or deformations so that the designer or manufacturer can proceed to the next step of pouring the silicone mold.

In the example shown, the nail polish fills in or coats imperfections 30, 35, and 40, to correct the shape of the ring's shank. It will be appreciated that the composition can be added to any portion of the jewelry item to adjust its shape in any manner desired. For example, the nail polish can be used to add to the surface of the model to change its shape or height as shown with respect to imperfection 45. Imperfection 45 consists of a bulge or protuberance from the model which is elevated above the model's surface. By placing a layer of nail polish on the model (and possibly over the protuberance, as well) the surface of the jewelry model can be made level. Although the examples shown illustrate the correction of imperfections in the model, it will be apparent that numerous other adjustments of the shape of the model can be effected by use of nail polish. These can be performed even for purely design oriented or aesthetic purposes, having nothing to do with the correction of errors or imperfections.

Consequently by addition of a nail polish composition to the jewelry model, a surface is formed in which imperfections in the model have been removed, or the shape of the model has been adjusted, or the appearance of the model has been changed. When an appropriate material such as silicone is poured around the jewelry model, it molds around the corrected surfaces. Thus, in the completed mold all distortions that had originally been present in the prior jewelry model have now been eliminated, or else new features or appearances have been added.

One example of a correction which can be performed to the model is to beef up a shank. When the model is too thin, nail polish or nail polish/enamel composition can be added to coat the shank and increase its thickness. If the model is still too thin after the coat dries, additional coats can be added until the desired thickness is achieved. Similarly, if a prong of the model is too thin, additional nail polish or nail polish/enamel composition can be added in as many coats as necessary until the prong is the desired thickness and/or shape.

Another example of a correction which can be performed is to increase the length of a prong. If a prong is too short a drop of nail polish can be placed on its top to increase its length. The nail polish then dries, increasing the length of the prong. If further increases in length are desired, the process can be repeated until reaching the requisite length.

A further example of a commonly needed correction is covering porosity. In the prior art, porosity has been a problem both on the metal and on areas which are soldered. Using the torch again on parts which were previously soldered can endanger the whole piece, leading it to melt or collapse. However, a small amount of nail polish is very effective to cover up porosity, and provide a smooth finish with ease.

Likewise, another correction which can be performed is to correct an asymmetric model or a gap in a model. The necessary area can be coated with nail polish to achieve the desire shape or conformation in the model. No soldering of a metal plate, as is the practice in the prior art, is necessary.

In addition to corrections in the model, a portion of the model making itself can be performed using the present method. For example, prongs can be added to the model by drilling holes in the model, pushing wire inside the hole, and filling the gaps with nail polish from top to bottom.

A setting can be attached to the model with a small drop of nail polish which affixes it in place. The placement of the setting can be adjusted before the nail polish dries. Any gaps between the setting and the model can be filled in with one or more further additions of nail polish.

Figure 3A:
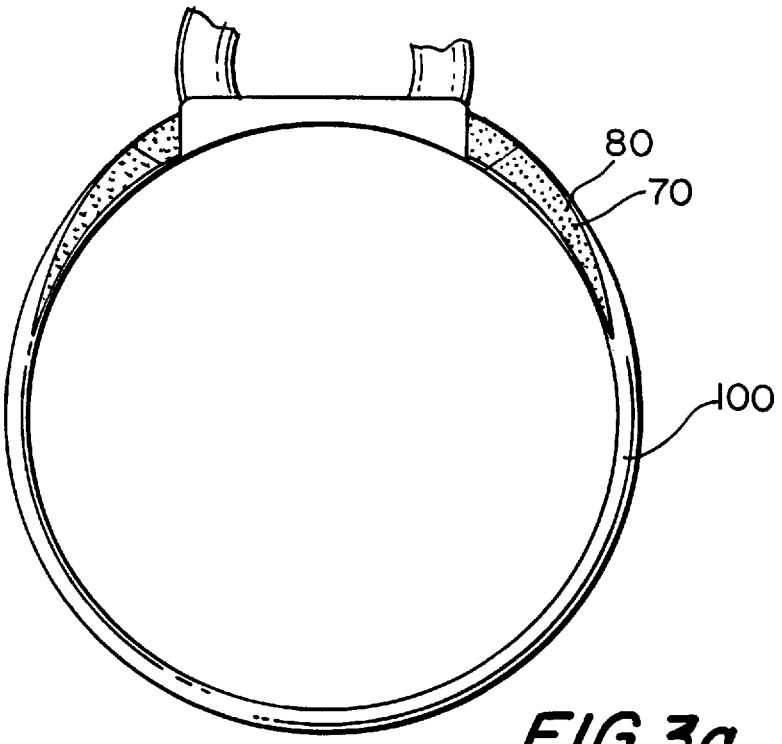
FIG. 3*a* is a side view of a jewelry model, with gold beads affixed thereon, using the present method and composition.
Figure 3B:
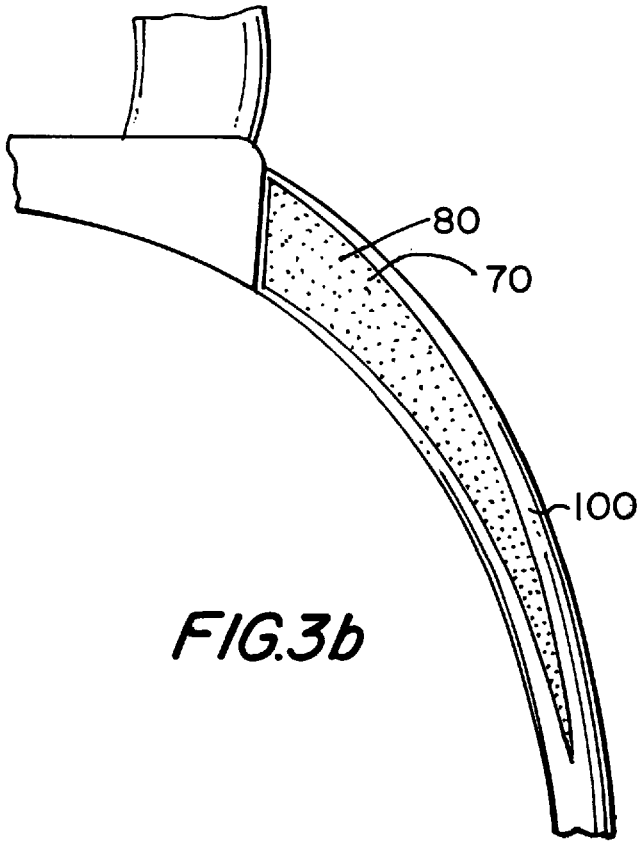
FIG. 3*b* is an enlarged section of the jewelry model of FIG. 3*a*, showing the gold beads affixed in the nail polish composition according to the present invention.

FIGS. 3*a* and 3*b* show the use of nail polish or nail polish/enamel composition to add additional jewelry elements to the model 100. Nail polish or nail polish composition is spread in a layer 70 to form a coating or substrate. Small gold beads or elements 80 are then deposited into the layer of nail polish to add a decorative ornamentation to the design. As the layer hardens, the gold beads 80 become affixed therein. If desired, multiple layers of elements can be added.

An example of a method to make and add these gold beads would be to take the smallest soldering pieces currently available in the trade, and to cut them in half. These half-pieces could then be melted with a torch. This will produce dozens of tiny gold beads (approximately ¼ mm or ½ mm in diameter). A portion of the model can then be coated with nail polish, as noted previously. After a few lines of gold beads are added, additional nail polish can be added to continue the process. This creates an excellent effect when used with rhodium plating.

Figure 4:
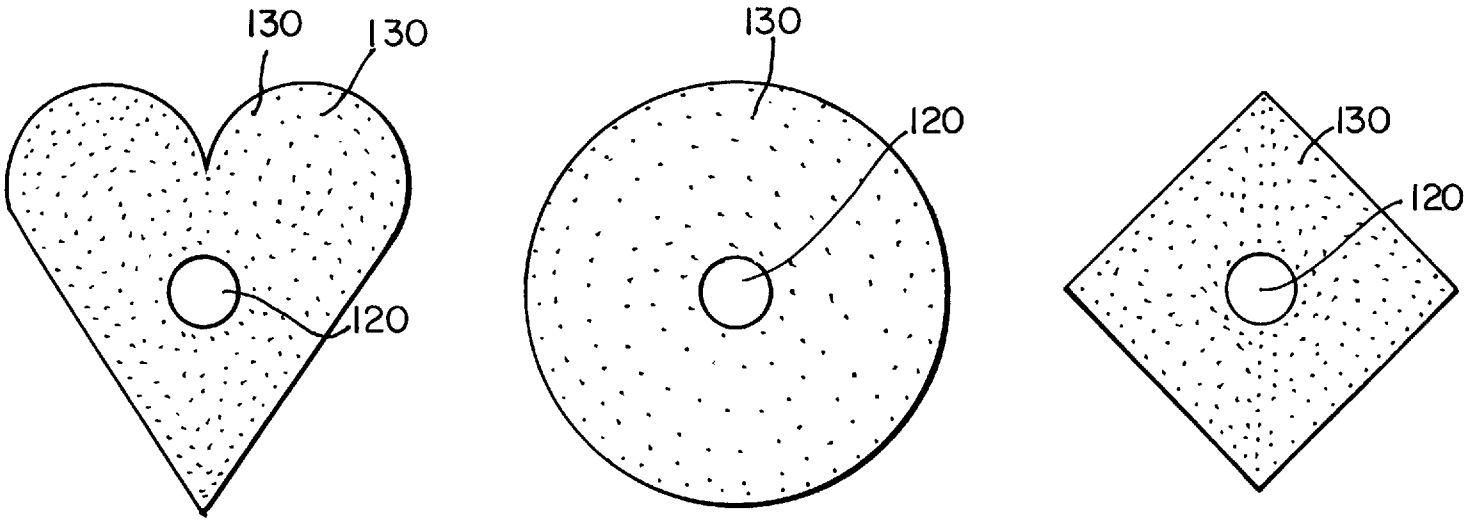
FIG. 4 is a top view of several miracle settings with gold beads added thereon, in accordance with a method of the present invention.

Similarly, the present method can also be used in conjunction with a miracle setting. A small section of the miracle setting, around the small diamond 120, is coated with nail polish. Gold beads 130 can then be placed on top of the nail polish. This can be continued with further sections until the whole miracle setting is covered with gold beads. FIG. 4 shows some examples of gold beads added to miracle settings, for illustration.

The final effect achieved by the present method can be extremely attractive after rhodium plating. Using rhodium plating in combination with the gold beads and/or the diamonds; or, a combination of different sizes of gold beads in one or more layers with the diamonds, achieves a highly attractive effect.

In addition to small beads, the present method can be used with large beads, as well. For example, large gold beads can be added to the model by drilling a hole on the model at the desired position to the appropriate size and depth. This hole can then be filled with the right quantity of nail polish, into which the gold bead is affixed.

It should be noted that after making the silicone mold, some small gold beads may occasionally be stuck therein. These beads must be removed before casting. In addition, cleaning off any residual, left-over nail polish from the silicone mold is also a necessity. Nail polish can be cleaned with nail polish remover, a soft toothbrush, and a sharp setting tool. If the residual nail polish or gold beads are not removed, distortions will appear on the cast pieces.

In conclusion, the present invention is excellent for fine jewelry, boutique pieces and good costume jewelry. It poses a significant advance over the prior art in that its elimination of the need to use heat in the process of building up the model allows greater design flexibility.

Having described this invention with regard to specific embodiments, it is to be understood that the description is not meant as a limitation since further variations or modifications may be apparent or may suggest themselves to those skilled in the art. It is intended that the present application cover such variations and modifications as fall within the scope of the appended claims.

I claim:

1. A method for improving a jewelry model having undesirable characteristics, comprising:

applying a nail polish composition to at least a portion of said jewelry model; and, allowing said nail polish composition to harden on said jewelry model.

2. A method as in claim 1, in which said application of said nail polish composition to said jewelry model is performed at substantially room temperature.

3. A method as in claim 1, wherein said jewelry model comprises metal, and wherein said application of said nail polish composition to said jewelry model is performed at a temperature below the melting point of said metal of said jewelry model.

4. A method as in claim 1, in which said nail polish composition further comprises enamel.

5. A method as in claim 2, in which said nail polish composition further comprises enamel.

6. A method as in claim 1, further comprising the step of pouring material around said jewelry model to form a mold of said jewelry model after said nail polish hardens.

7. A method as in claim 6, in which said material comprises silicone.

8. A method as in claim 1, further comprising the step of forming a layer of said nail composition on said jewelry model, and adding jewelry elements to said layer.

9. A method as in claim 8, in which said nail polish composition further comprises enamel.

10. A method as in claim 8, in which said jewelry elements are beads.

11. A method as in claim 10, in which said beads are gold.

12. A method as in claim 11, in which said gold beads are one quarter of a millimeter in diameter or less.

13. A method as in claim 1, further comprising the step of adding rhodium to said jewelry model.

14. A method of making jewelry, comprising:

making a structure of a desired jewelry design;

forming a preliminary mold of said structure;

adding metal to said preliminary mold to make a jewelry model; and, applying a nail polish composition to said jewelry model.

15. A method as in claim 14, further comprising the step of adding jewelry elements to said nail polish composition.

16. A method as in claim 14, further comprising the step of pouring material around said jewelry model to form a mold of said jewelry model.

17. A method as in claim 16, in which said material comprises silicone.

18. A method as in claim 17, further comprising the step of pouring metal into said mold comprised of silicone, to form a casting of an item of jewelry.

19. A method as in claim 14, in which said nail polish composition further comprises enamel.

20. A jewelry model, said jewelry model comprising a structure for the creation of a jewelry mold, said jewelry model comprising a coating of a nail polish composition on at least a portion of said jewelry model, said coating being located on areas of said jewelry model to change the appearance of said jewelry model.

21. A jewelry model as in claim 20, in which said structure comprises metal.

22. A jewelry model as in claim 20, in which said jewelry model further comprises jewelry elements added to said jewelry model, said jewelry elements being affixed to said jewelry model by location of at least a portion of said jewelry elements in a layer of said nail polish composition.

23. A jewelry model as in claim 20, in which said jewelry model further comprises rhodium.

24. A jewelry model as in claim 20, in which said nail polish composition further comprises enamel.

* * * * *